US008701321B2

(12) United States Patent
Da Fonseca et al.

(10) Patent No.: US 8,701,321 B2
(45) Date of Patent: Apr. 22, 2014

(54) AUTOMATICALLY ACTUATED, Z-SHAPED PUBLICITY DISPLAY TOTEM

(75) Inventors: Fernando Gonçalves Da Fonseca, Rio de Janeiro (BR); Paola Geremia Fernandez, Rio de Janeiro (BR)

(73) Assignee: PDV Total Comércio de Material Promocional LTDA, Rio de Janeiro (BR)

( * ) Notice: Subject to any disclaimer, the term of this patent is extended or adjusted under 35 U.S.C. 154(b) by 0 days.

(21) Appl. No.: 13/635,237

(22) PCT Filed: Mar. 10, 2011

(86) PCT No.: PCT/BR2011/000060

§ 371 (c)(1),
(2), (4) Date: Nov. 14, 2012

(87) PCT Pub. No.: WO2011/113123

PCT Pub. Date: Sep. 22, 2011

(65) Prior Publication Data

US 2013/0192110 A1 Aug. 1, 2013

(30) Foreign Application Priority Data

Mar. 15, 2010 (BR) ..... 1002330

(51) Int. Cl.
*G09F 7/00* (2006.01)

(52) U.S. Cl.
USPC ..... 40/610; 40/603; 160/351

(58) Field of Classification Search
USPC ..... 135/125, 126, 143; 40/124.09, 40/124.11–124.16, 124.19, 124.191, 610
See application file for complete search history.

(56) References Cited

U.S. PATENT DOCUMENTS

| | | | | |
|---|---|---|---|---|
| 4,773,622 | A * | 9/1988 | Herlin | 248/174 |
| 5,046,543 | A * | 9/1991 | Levy | 160/84.04 |
| 5,116,273 | A * | 5/1992 | Chan | 160/370.21 |
| 5,553,908 | A * | 9/1996 | Shink | 296/97.8 |
| 6,357,510 | B1 * | 3/2002 | Zheng | 160/354 |
| 6,497,601 | B1 * | 12/2002 | Ward | 446/71 |
| 7,398,612 | B2 * | 7/2008 | Zheng | 40/603 |
| 7,918,044 | B2 * | 4/2011 | Lopez | 40/603 |
| 8,091,605 | B1 * | 1/2012 | Melhart | 160/135 |
| 8,291,631 | B2 * | 10/2012 | Wilder | 40/661.09 |
| 2006/0289047 | A1 * | 12/2006 | Zheng | 135/126 |
| 2012/0227297 | A1 * | 9/2012 | Kawaguchi et al. | 40/610 |
| 2013/0192110 | A1 * | 8/2013 | Da Fonseca et al. | 40/606.12 |

* cited by examiner

*Primary Examiner* — Shin Kim
(74) *Attorney, Agent, or Firm* — Jeffrey N. Townes; LeClairRyan

(57) ABSTRACT

The invention is related to an automatically activated z-shaped model totem pole type display apparatus, used for visual communication, advertising and propaganda, for provision of information on products and services at points of sale and events, comprised by only four pieces, including two internal devices that form a Z-shape upon automatic activation and two external panels with the optional addition of a base and top plate for outdoor use, which apparatus may be easily assembled and disassembled by the end user, where in order to facilitate the transport and storage thereof upon disassembly, the apparatus may be flattened and folded one or more times to thereby assume what practically amounts to the shape of a folded plate and enabling the accommodation thereof in a carrying case.

11 Claims, 9 Drawing Sheets

AUTOMATICALLY ACTUATED, Z-SHAPED PUBLICITY DISPLAY TOTEM

CROSS-REFERENCE TO RELATED APPLICATIONS

This application is a national stage application, submitted under 35 U.S.C. §371, of PCT Application No. PCT/BR2011/000060, filed Mar. 10, 2011, which claims priority to Brazil Application No. PI 1002330-5, filed Mar. 15, 2010, both of which are hereby incorporated by reference in its entirety.

FIELD OF THE INVENTION

The present invention was developed by means of technical and functional improvements, and it is related to the development of a Z-shaped model totem pole display apparatus with automatic activation, which structure is comprised of only four pieces, consisting in two internal devices and two external panels, and which is easily assembled and placed in its usage position and also easy to disassemble. In order to facilitate its transport and storage after disassembling, the device can be flattened and folded once or more times to thereby assume what is practically the shape of a folded plate or board. It is characterized as an optimum supporting media for visual communication, advertising and propaganda, providing information on products and services at points of sale and events.

PRIOR ART

It is undeniable that the models known in the art are commercialized in folded and assembled condition, however such models make use of several pieces of cardboard with slits and engagement fitting means, elastic elements, a stand-up base, etc. Due to the fact that the materials used are not weather resistant and their light weight renders them unstable, these devices are known as indoor display apparatuses, that is, they are only adequate to be used indoors. The manufacture of those devices entails complex details of construction and assembly, using several internal pieces for two-faced devices or external pieces for single-faced devices, resulting in high production costs, rendering the same inadequate for use by small and middle-sized business entities.

OBJECTS OF THE INVENTION

The object of the present invention consists in the production and provision of a Z-shaped model totem pole type display apparatus with automatic activation to facilitate the transport and storage thereof Upon disassembly, the totem pole can be flattened and folded for accommodation in a carrying case. In order to assemble the apparatus automatically the same is merely unfolded and thereby its internal devices are automatically triggered to operate. The structure of the apparatus comprises two internal devices that upon being activated form a Z-shape of paperboard or a similar material, including the possible use of a flexible plastic material, and two external panels made of paperboard/cardboard or a flexible plastic material whereon will be printed the information to be displayed.

For indoor used in sheltered environments, the automatically activated totem pole type display apparatus, upon being assembled, can be directly set up on the floor, and its internal paperboard device and the outer panels will be made of cardboard/paperboard, while for outdoor use in open outdoor environments the internal devices and the external panels will be made of flexible plastic material, with an additional base and top plate developed to provide enhanced stability thereto and to seal the apparatus to thereby protect the same from the weather. The dimensions of the assembled and/or disassembled totem pole type display apparatus (width×height×length) will be freely chosen in accordance with the information to be displayed and the display location.

Therefore, the present invention provides improvements that entail significant advantages in terms of manufacture and use when compared with previously existing models, and the characteristics, advantages and objects of the invention will be better understood upon reading the description and the examples provided herein with the attached drawings.

BRIEF DESCRIPTION OF THE DRAWINGS

FIG. 1 is a depiction of the internal device 1 of the Z-shaped model totem pole type display apparatus with automatic activation, made of paperboard or a similar material (for which purpose there may also be used a flexible plastic material), in an open configuration, with two vertical creases provided in parallel 2 in order to be folded and assume a Z-shape upon activation, causing the totem pole type apparatus to assume a semi-cylindrical shape, in both faces, with two holes provided in the side 3 for fastening the devices, with the use of clasps, to the external panels, a wire spring 4 in the open position, four slits 5, provided in parallel and horizontally, for engagement of the spring prongs, and a hole 6 with a rectangular shape to accommodate the spring body.

FIG. 2 is a depiction of the internal device in the folded state 7 with a wire spring in the closed position 8, such as it will be placed between the external panels, one of which at the upper part and the other at the lower part.

FIG. 3 shows a top view of the totem pole type display apparatus in the assembled state 9 with the automatically activated Z-shaped internal device 10 in the assembled state, causing the external panels to assume a semi-cylindrical shape.

FIG. 4 depicts the external panels 11 of the totem pole type apparatus made of paperboard or a similar material for indoor use or made of a flexible plastic material for outdoor use, in an open configuration with slits on the sides to form closing tabs 12, four parallel creases provided horizontally 13 to enable the folding thereof on disassembly, two parallel creases provided vertically 14 to enable the tabs to be folded backwards and holes 15 for joining the two external panels and to fasten the automatically activated Z-shaped model devices with the use of clasps.

FIG. 5 is a front or rear view 16 of the automatically activated Z-shaped model totem pole type display apparatus in its assembled state, where it comprises two semi-cylindrical display faces, one of these being a front face and the other being a rear face.

FIG. 6 shows a top view of the base or top plate 17 with a protuberance for fitting engagement 18 of the external panels.

FIG. 7 is a front view of the base or top plate 19 made of a plastic material with a protuberance for fitting engagement 20 of the external panels.

FIG. 8 is a front view of one of the front or rear faces of the totem pole type apparatus 21 with the base and the top plate 22.

FIG. 9 represents the totem pole type apparatus being disassembled 23 to be transported or stored. When fully folded, the apparatus assumes what practically amounts to the shape of a folded plate, whereby it may be accommodated in a carrying case.

Figure 1:
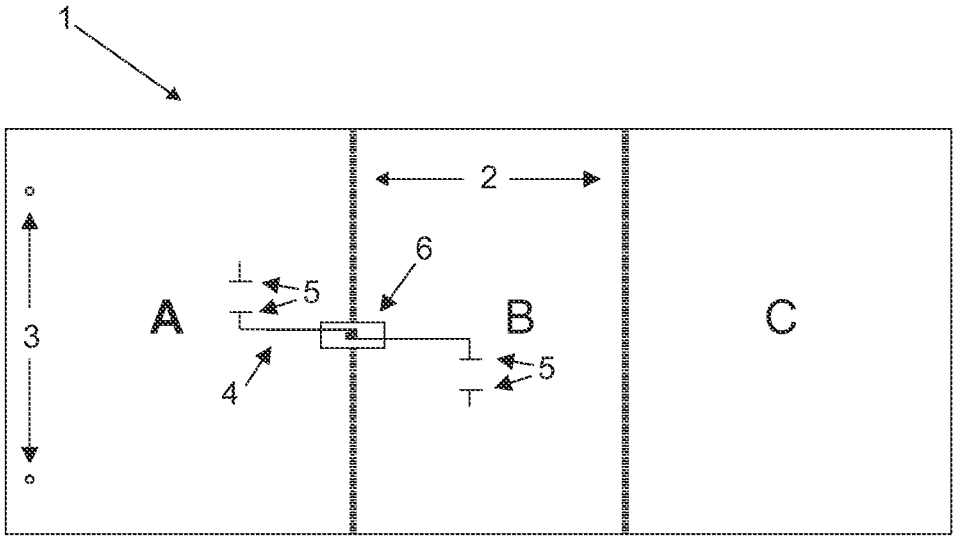
FIG. 1 illustrates the internal device of the Z-shaped model totem pole type display apparatus with automatic activation in accordance with the present invention.
Figure 2:
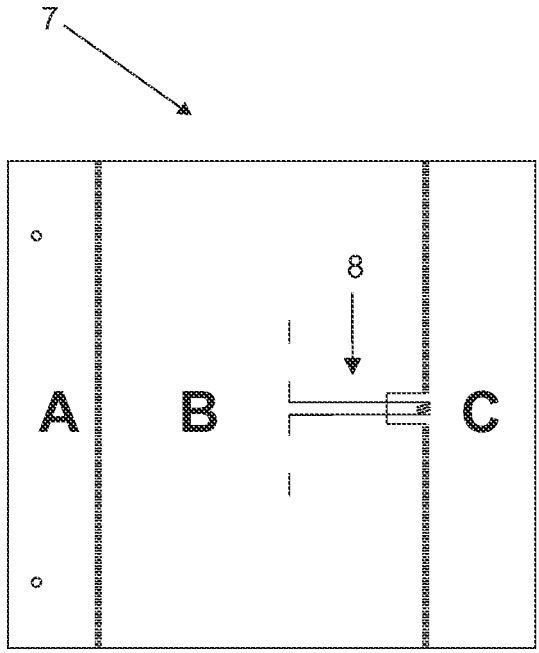
FIG. 2 illustrates the internal device in the folded state.
Figure 3:
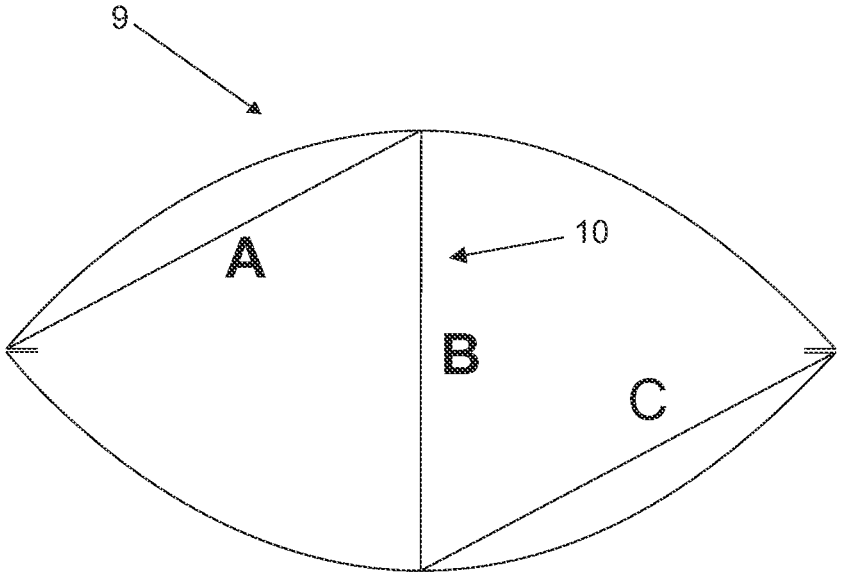
FIG. 3 is a top view of the totem pole type display apparatus in the assembled state.
Figure 4:
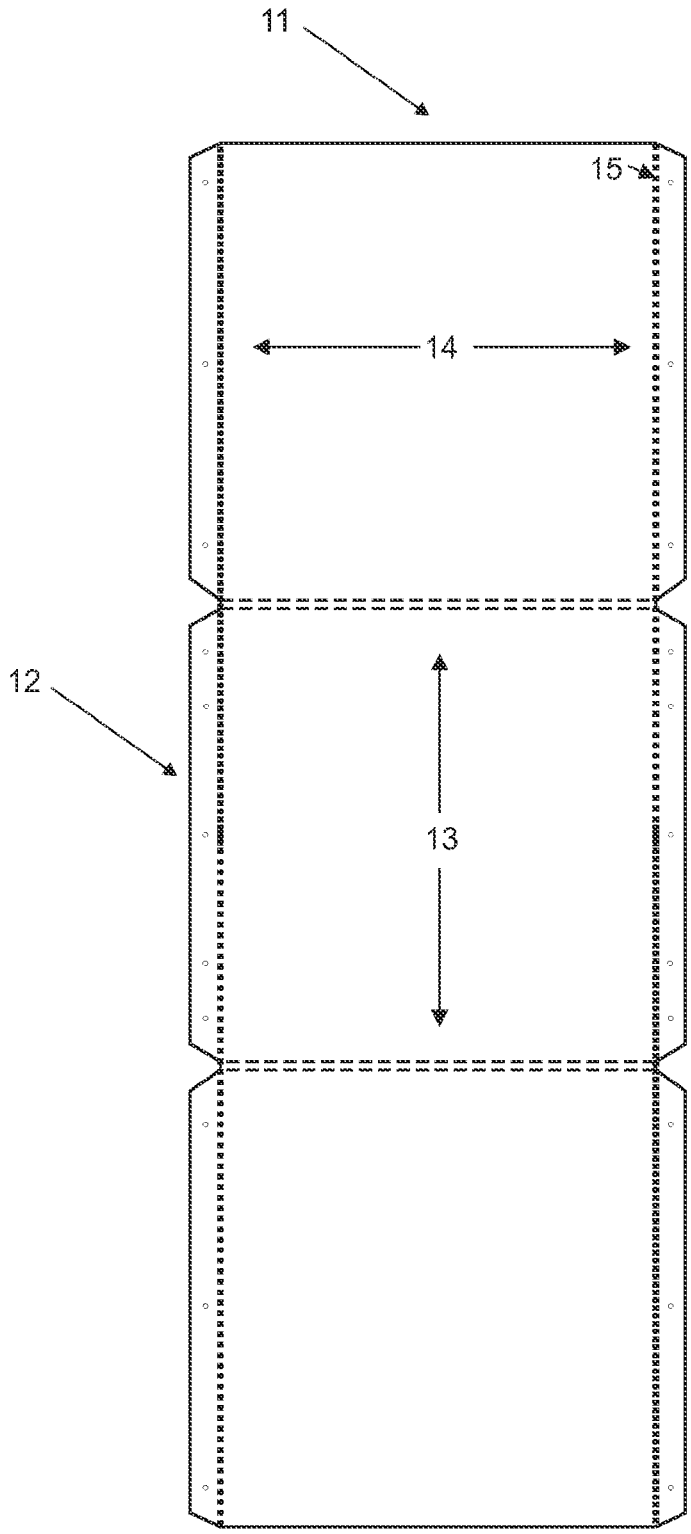
FIG. 4 illustrates the external panels of the totem pole type display apparatus.
Figure 5:
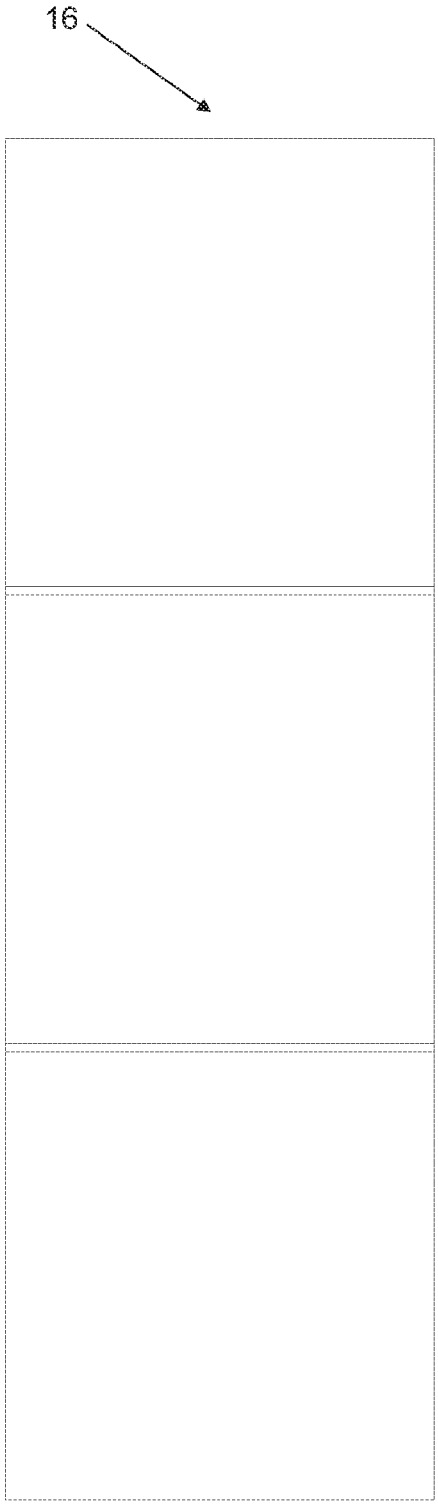
FIG. 5 shows a front or rear view of the totem pole type display apparatus in the assembled state.
Figure 6:
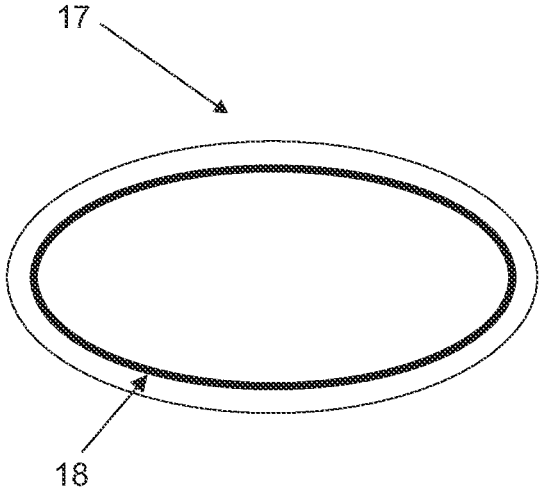
FIG. 6 depicts a top view of the base or top plate of the totem pole type display apparatus according to the present invention.
Figure 7:
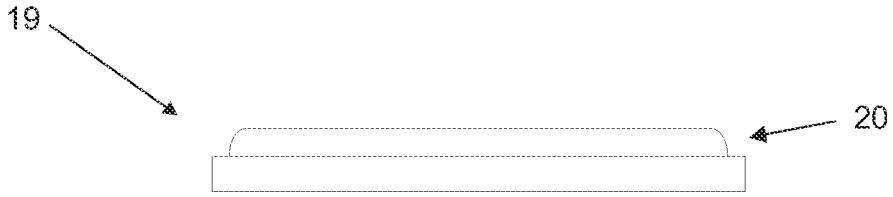
FIG. 7 depicts a front view of the base or top plate of the totem pole type display apparatus according to the present invention.
Figure 8:
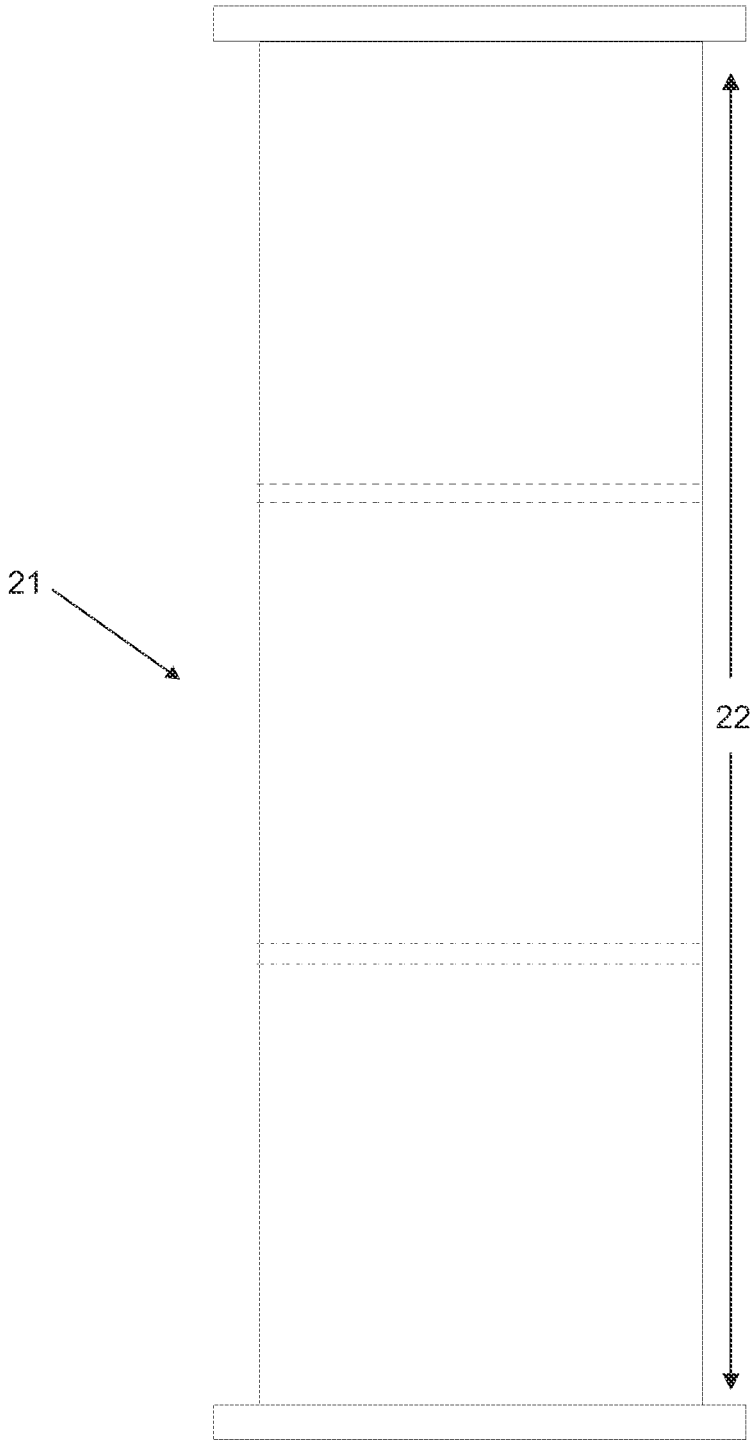
FIG. 8 depicts a front view of one of the front or rear faces of the totem pole type display apparatus in the assembled state.
Figure 9:
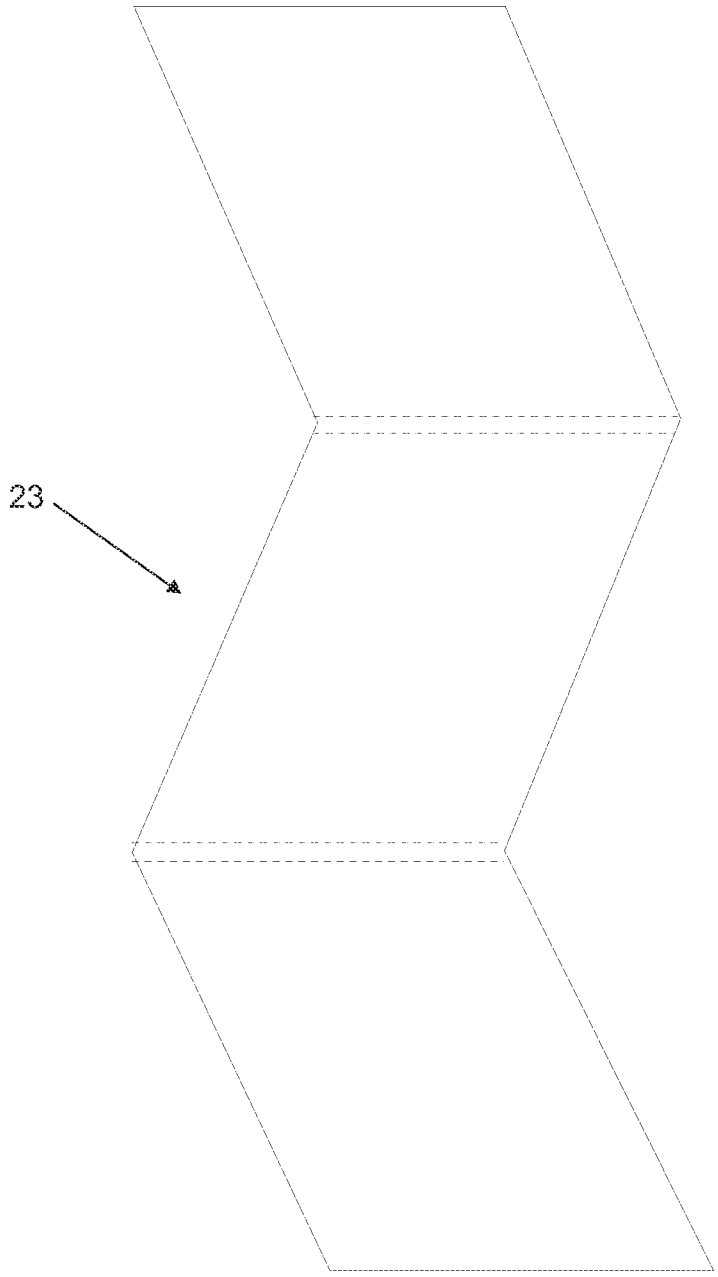
FIG. 9 shows the totem pole type display apparatus in the disassembled state.

What is claimed is:

1. An automatically actuated, Z-shaped publicity display totem pole type apparatus, comprising:

at least two automatically activated Z-shaped internal devices with two parallel creases provided in a vertical arrangement to be folded assuming the shape of a Z;

a wire spring for automatic activation causing the totem pole type apparatus to assume a semi-cylindrical shape; and at least two external panels with four parallel creases to enable horizontal folding and a plurality of tabs on opposing sides of the at least two external panels that are turned backwards by folds present in the vertical part of the tabs and closed with clasps at the sides to close the totem pole type apparatus and to fasten the at least two internal devices.

2. The apparatus as set forth in claim 1, wherein the at least two internal devices and the at least two external panels are made of paperboard or a flexible plastic material or similar material.

3. The apparatus as set forth in claim 1, wherein the plurality of tabs includes a plurality of apertures for joining and fastening the internal devices, with the use of the clasps, to the external panels.

4. The apparatus as set forth in claim 1, wherein the at least two internal devices includes a plurality of slits, provided in parallel and horizontally, for engagement of the wire spring, and at least one aperture provided within at least one of the two parallel creases to accommodate the wire spring.

5. The apparatus as set forth in claim 1, wherein the semi-cylindrical shape comprises a front face and a rear face.

6. The apparatus as set forth in claim 1, wherein the wire spring comprises an open position and a closed position, and is removably engaged to the at least two internal devices for automatic activation causing the external panels to assume at least two semi-cylindrical shape when the wire spring is in the open position.

7. The apparatus as set forth in claim 1, wherein the apparatus further comprises a base and top plate to fittingly engage the external panels to thereby seal the apparatus and enable the use thereof in outdoor environments.

8. The apparatus as set forth in claim 7, wherein the base and top plate comprises a protuberance for fitting engagement of the external panels.

9. The apparatus as set forth in claim 7, wherein the base and top plate is made of a plastic material.

10. The apparatus as set forth in claim 1, wherein the apparatus may be made of paperboard or a similar material suitable for an indoor environment.

11. The apparatus as set forth in claim 1, wherein the apparatus is comprised of only four pieces.

* * * * *